United States Patent [19]

Hayes

[11] 3,947,904

[45] Apr. 6, 1976

[54] ELECTRICANS' COMBINATION TOOL

[75] Inventor: William H. Hayes, Helena, Ala.

[73] Assignee: Efficiency Tool Company, Inc., Pelham, Ala.

[22] Filed: Nov. 22, 1974

[21] Appl. No.: 526,119

[52] U.S. Cl. ..... 7/3 A; 7/8.1 R

[51] Int. Cl.[2] ..... B25F 1/00

[58] Field of Search..... 7/8.1 R, 8.1 A, 3 R, 3 A, 7/5.4, 5.5, 14.1 R; 30/90.4, 90.8; 81/9.5 R

[56] References Cited

UNITED STATES PATENTS

| | | | |
|---|---|---|---|
| 300,244 | 6/1884 | Gambrell | 7/3 R |
| 1,699,805 | 1/1929 | Ocko | 7/5.5 |
| 1,800,317 | 4/1931 | Ries et al. | 81/9.5 R |
| 2,410,252 | 10/1946 | Torrence | 81/9.5 R |
| 3,014,387 | 12/1961 | Medlin | 81/9.5 R |
| 3,572,187 | 3/1971 | Glassburn | 7/3 R |

FOREIGN PATENTS OR APPLICATIONS

| | | | |
|---|---|---|---|
| 255,825 | 11/1927 | Italy | 7/3 A |

*Primary Examiner*—Al Lawrence Smith
*Assistant Examiner*—Roscoe V. Parker

[57] ABSTRACT

A combination tool comprises first and second handles movably pivoted together at a pivot axis, with respective first and second shanks extending from the pivot axis and joined to the corresponding handle. A tool member is joined substantially normal to each shank, and substantially parallel with the pivot axis, each tool member having a flat end surface substantially parallel with the corresponding shank. The upper surface of the tool members have opposing indentations therein, serving as a recess for receiving wire for stripping purposes. When the opposing surfaces of the tool members abut one another, the end surfaces of the tool member define a flat hammer face.

5 Claims, 4 Drawing Figures

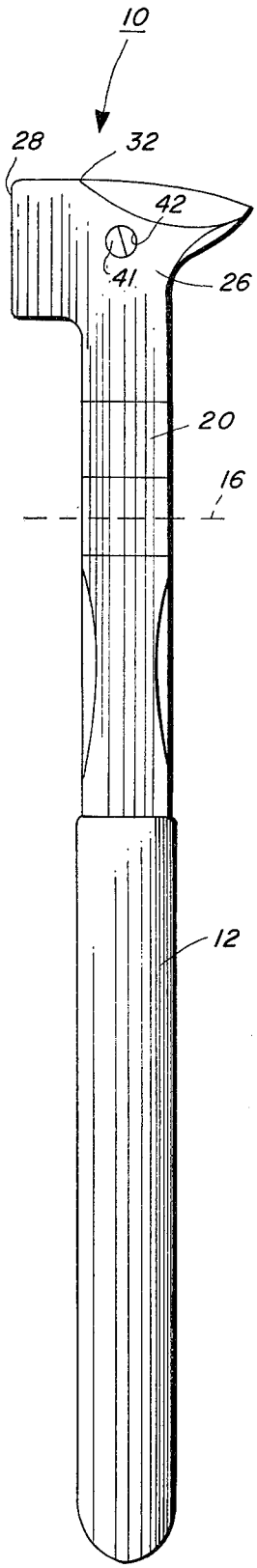
FIG. 1
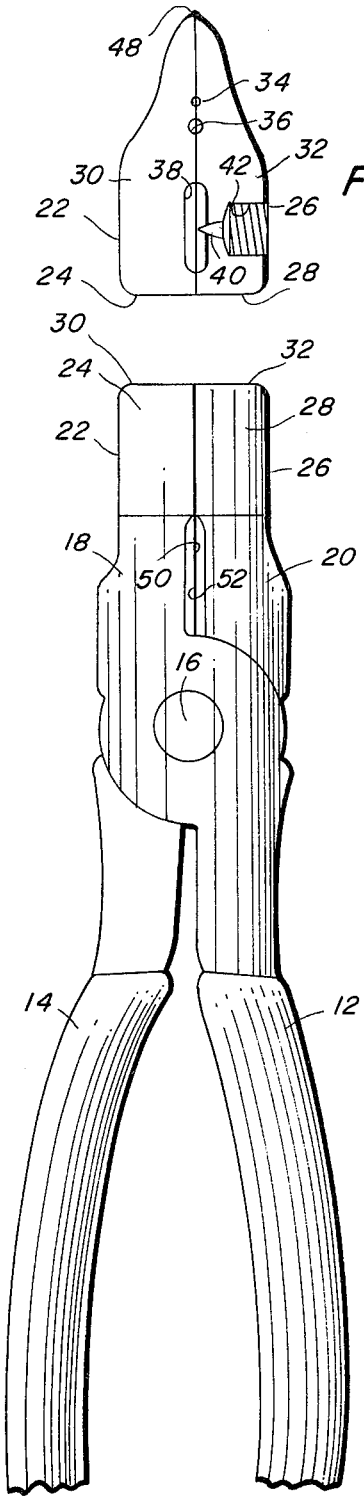
FIG. 2
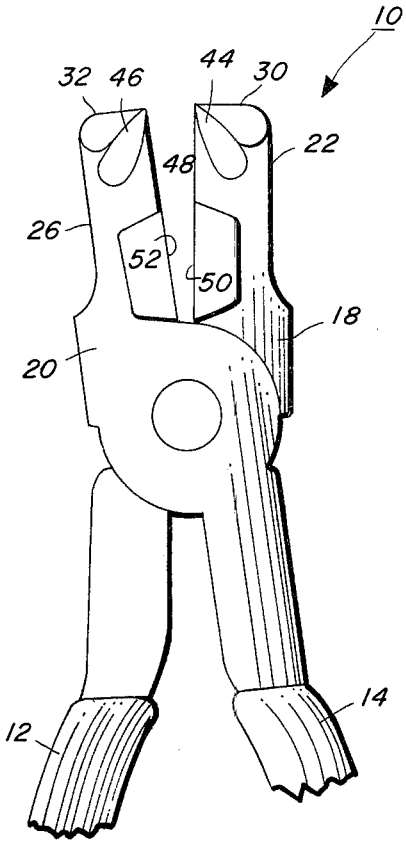
FIG. 3
FIG. 4

ELECTRICANS' COMBINATION TOOL

BACKGROUND OF THE INVENTION

1. Field of the Invention

The present invention relates to the tool art, and in particular relates to combination tools which are useful for performing a plurality of work functions.

2. Description of the Prior Art

Electricians must frequently perform a variety of work functions in small confines where it is inconvenient to bring a tool chest. Many of these functions are repetitious, alternately requiring a small hammer for driving staples of the type used to affix electrical wiring to building studs, a wire cutter for cutting the electrical wiring and cable at the appropriate point, wire strippers for removing the insulation as needed, and occasionally, a staple puller to remove an improperly driven staple. For convenience, many electricians wear a small tool kit on a belt about the waist, and carry therein only those most needed tools.

Even the most skilled electrician looses a considerable amount of time in removing and replacing tools located in the tool belt. Further, the electrician frequently leaves one tool at another location, thus requiring that he cease working until that tool is retrieved. Additionally, when wire stripping as described above, the electrician is often required to strip the insulation from heavy, class NMC wiring of the type most frequently used in the building trade. Conventional wire strippers are pliers-type arrangements having indentations which cut through the insulation and are adapted to strip the wire by a movement which is perpendicular to the direction of the handles. However, such wire strippers are particularly unsuited for the electrical trade of the type described for two reasons. First, the end of the wire is frequently located within an outlet box or similar confines, and the electrician is unable to reach inside these confines in order to strip the insulation from the wire at the desired point. Second, with conventional wire strippers, the electrician must apply a force in a direction substantially perpendicular to his greatest strength; that is, perpendicular to the shaft defined by the arm, rather than being able to apply a pulling movement along the direction of the arm.

Further, another type of cable commonly referred to as ROMEX cable is now being used extensively in the construction trade. ROMEX cable consists of a flat ribbon strip having the conducting pair disposed on opposite sides of the insulating ribbon. It is often necessary to cut the insulation of a ROMEX pair between the conductors. However, conventional wire strippers do not provide means for performing this function.

There have been suggestions in the prior art for providing combination tools which will perform some of the functions just described above. In U.S. Pat. No. 1,675,476, West discloses a pliers-type combination tool particularly adapted for constructing and repairing wire fencing. Louden, in U.S. Pat. No. 836,075, also discloses a combination tool for performing multiple functions. Adams, in U.S. Pat. No. 1,388,398, discloses a wire stripper of the type described above. Other combination tool devices are disclosed in U.S. Pat. Nos. 2,364,801 to Martines; 511,107 to Becker; and 1.346,392 to Whitaker.

SUMMARY OF THE INVENTION

The present invention contemplates a combination hammer and wire stripping tool comprising first and second handles movably joined together at a pivot axis, with first and second shanks extending from the pivot axis and integrally joined with the respective one of the first and second handles. First and second tool members are joined and are substantially normal to the corresponding one of the first and second shanks, both tool members being substantially parallel with the pivot axis and having a corresponding flat end surface substantially parallel with the corresponding shank. Each tool member has a surface with indentations therein, such that the indentations of one tool member oppose that of the other tool member, so as to define a wire stripping aperture across the top of the tool members which allows the operator to strip wire by inserting the wire between the tool members and in the indentations, and performing the stripping function by a pulling in a direction substantially parallel with the handles. The end surfaces of the respective tool members define a flat hammer face when the opposing surfaces of the tool member abut one another.

In a preferred embodiment of the present invention, the tool members are tapered at an end opposite the flat hammer face, the tapered end defining a staple puller. Further, the preferred embodiment includes sharpened inner surfaces of the first and second shanks between the pivot axis and the tool members, so as to define a wire cutter. Additionally, the preferred embodiment includes an elongated indentation among the wire stripping indentations described above, with a sharpened point extending into the indentation so as to provide a means for splitting ROMEX-type cable.

THE DRAWING

FIG. 1 is a side view illustrating the preferred embodiment of the present invention.

FIG. 2 is a front view, partially cut-away, of the embodiment of FIG. 1.

FIG. 3 is a top plan view of the embodiment of FIGS. 1 and 2.

FIG. 4 is a rear view of the embodiment shown in FIGS. 1, 2 and 3.

DETAILED DESCRIPTION

A preferred embodiment of the combination tool of the present invention will now be described with references to FIGS. 1, 2, 3 and 4. The tool, referred to generally as 10, includes first and second handles 12 and 14 respectively, movably joined together at a pivot axis 16. A first shank 18 extends from the pivot axis 16 and is joined with the first handle 12. Likewise, a second shank 20 extends from the pivot axis 16 and is joined to the second handle 14. Preferably, the shanks 18, 20 are forged, machined or otherwise formed integrally with the corresponding handles 12, 14. A first tool member 22 is joined, and preferably formed integrally with the first shank 18, and includes a first flat end surface 24 which is substantially parallel with the shank 18 and substantially normal to the pivot axis 16. Likewise, a second tool member 26 is joined, and is preferably joined integrally with the second shank 20 and includes a second, flat end surface 28 which is likewise parallel with the corresponding shank 20 and perpendicular to the pivot axis 16. Thus formed, and as shown in the drawings, the first and second tool members 22 and 26 are formed substantially parallel with the pivot axis 16. Further, the first and second tool members 22, 26 include opposing surfaces, respectively identified as 30 and 32 in the drawings. Each surface 30, 32 has a plurality of openings, as 32, 36 and 38 therein, each of which extends substantially parallel with the shanks 18, 20. One of the openings 38 is oblong, and includes a pointed obtrusion 40 extending therein. The obtrusion 40 is variably positioned in the opening 38 by a screw 41 fitted in a threaded hole 42 extending through the tool member 26. Each tool member 22, 26 includes a corresponding, tapered portion 44, 46 extending parallel with the pivot axis and substantially normal from the corresponding shank 18, 20 and defining a pointed extension 48 at the extremity thereof.

With specific reference to FIGS. 2 and 4, the inner periphery of each shank 18, 20 defines a cutting blade 50 and 52, respectively.

The utility of the tool 10 will now be described. First, as will be clear to those skilled in the art, the flat surfaces 24 and 28 define a hammer face when the first and second tool members 22 and 26 abut one another. Second, the tapered portions 44, 46 of the first and second tool members 22, 26 define a staple puller. Third, the cutting blades 50, 52 define a wire cutter, for wire extending between the tool members in a direction substantially parallel with the pivot axis. Fourth, the openings 34, 36 and 38 define means for stripping insulation from wire; in particular, the oblong opening 38 and the protrusion 40 are particularly adapted for use with ROMEX cable. Further, it is important to note that the wire stripping function is achieved by inserting the wire between the tool members in a direction substantially normal to the pivot axis 16 and substantially parallel with the shanks 18, 20 and the handles 12, 14. Thus, the wire stripping function can be achieved in a direction in which the most strength can be exercised by the operator of the tool 10, that is, in a direction substantially parallel with the arm. In addition, the wire stripping openings 34, 36 and 38 are at an extreme surface, e.g. surface 32, of the tool member 10, thus allowing the stripping action to be made in relatively inaccessable areas.

I claim:

1. A combination tool comprising:

a first handle;

a second handle movably joined with said first handle at a pivot axis;

a first shank extending from said pivot axis and joined with said first handle;

a second shank extending from said pivot axis and joined with said second handle;

a first tool member joined and substantially normal to said first shank, and substantially parallel with said pviot axis, said tool member having a first flat end surface substantially parallel with said first shank;

a second tool member joined and substantially normal to said second shank, and substantially parallel with said pivot axis, said tool member having a second flat end surface substantially parallel with said second shank;

said first and second tool members having opposing surfaces with corresponding openings therein substantially parallel with said shanks and substantially normal to said pivot axis, one of said openings comprising an oblong opening;

a protrusion extending from one of said tool members into said oblong opening;

means for changing the dimension of said protrusion into said oblong opening; and wherein said first and second end surfaces define a flat hammer face with said opposing surfaces of said tool members abutting each other, and said openings define means for stripping insulation from wire extending between said tool members in a direction substantially parallel with said shanks.

2. The tool recited in claim 1 wherein said dimension changing means comprises:

one of said first and second tool members having a threaded hole extending threin substantially transverse to said oblong opening, with said protrusion extending through said threaded hole and into said oblong opening;

means for retaining said protrusion in said threaded hole; and a screw fitted into said threaded hole.

3. The tool recited in claim 1 wherein:

each said tool member further includes a tapered portion extending away from the corresponding one of said shanks; and wherein said tapered portions define a pointed extension adapted to pull staples and the like.

4. The tool recited in claim 3 wherein said tapered portions are substantially parallel with said pivot axis.

5. The tool recited in claim 3 further comprising:

each shank defining a cutting blade opposing a line cutting blade on the other one of said shanks; and wherein said cutting blades define means for cutting wire or the like inserted between said shanks in a direction substantially parallel with said pivot axis.

* * * * *